US007306500B1

(12) United States Patent
Spangler et al.

(10) Patent No.: US 7,306,500 B1
(45) Date of Patent: Dec. 11, 2007

(54) DEVICE FOR REDIRECTING BOAT MOTOR EXHAUST

(76) Inventors: Lysle Spangler, 333 W. Catlett Rd., Nicolaus, CA (US) 95659; Ryan Hansen, 333 W. Catlett Rd., Nicolaus, CA (US) 95659

( * ) Notice: Subject to any disclaimer, the term of this patent is extended or adjusted under 35 U.S.C. 154(b) by 61 days.

(21) Appl. No.: 11/000,669

(22) Filed: Nov. 30, 2004

(51) Int. Cl.
*B63H 21/34* (2006.01)

(52) U.S. Cl. ..... 440/89 R

(58) Field of Classification Search ..... 440/39, 440/89 R; 441/133; 454/63, 64; 285/396, 285/401, 402
See application file for complete search history.

(56) References Cited

U.S. PATENT DOCUMENTS 1,002,264 A * 9/1911 Gribber ..... 285/376
3,489,182 A * 1/1970 Cameron ..... 138/103
RE31,047 E * 10/1982 Ross ..... 138/130
4,699,597 A * 10/1987 Oja ..... 440/66
4,796,520 A * 1/1989 Kramer, Jr. ..... 454/367
5,591,058 A * 1/1997 Schriever et al. ..... 440/89 R

* cited by examiner

*Primary Examiner*—Ed Swinehart
(74) *Attorney, Agent, or Firm*—John P. Costello

(57) ABSTRACT

The present invention is a device which redirects motor exhaust fumes a distance away from a boat. This device can be applied to a boat's propulsion motor or to its generator for purposes of preventing carbon monoxide poisoning of a boat's passengers. The device includes an adaptor for attaching to a boat motor exhaust port and an elongate extension hose attached to the adaptor. The extension hose is made buoyant through use of a plurality of flotation collars disposed along the length of the hose. An extension rod is inserted into the collars to keep the hose rigid and the distal exhaust end of the hose directed away from a boat to which the device is attached.

18 Claims, 3 Drawing Sheets

DEVICE FOR REDIRECTING BOAT MOTOR EXHAUST

1. TECHNICAL FIELD

This invention relates to the field of boating accessories and, more specifically, to an apparatus for redirecting boat internal combustion motor exhaust to a location far exterior from a boat so that carbon monoxide buildup will not occur near a boat where passengers can be affected.

2. BACKGROUND

Motorized pleasure boats are abundant and growing in numbers on the world's waterways. Pleasure boating is generally a safe form of recreation. Nevertheless, this sport has seen its share of deaths and injuries caused by carbon monoxide poisoning. One instance of this is due to the phenomenon of deaths occurring during "teak surfing." Teak surfing is an activity which involves individuals grasping the swim deck located behind a boat's transom for purposes of being pulled through the water, either bodily, or on a flotation apparatus. However, on motor boats with swim decks, the exhaust ports are usually located below the swim deck, near the waterline. The air space between the waterline and the bottom of the swim deck operates as a collection "pocket" for poisonous carbon monoxide exhaust gas. Carbon monoxide, if breathed by a human in sufficient quantities, can displace oxygen and cause unconsciousness and death. Teak surfers and swimmers, being directly adjacent to the carbon monoxide collection pockets or exhaust ports on boats can experience carbon monoxide overload, which has led to deaths in a number of incidents.

Carbon monoxide can also waft into a boat's cabin after being deflected off the boat's own wake upon exiting from the boat's exhaust ports. There have been cases where enough carbon monoxide has entered a cabin from this phenomenon to cause passengers to be overcome and killed.

Onboard gasoline electricity generators can also be a source of carbon monoxide on boats. Generator exhaust ports are typically located on the side of most boats, and if the generator is running, carbon monoxide fumes can waft upward into the breathing space of boat passengers.

Therefore, a need exists for a device which can prevent high concentrations of carbon monoxide from developing in areas on, or near a boat, where passengers could breathe these fumes and be affected by them.

SUMMARY OF THE INVENTION

The present invention is a device for redirecting boat motor exhaust from a boat's exhaust ports to a location far removed from the boat. This invention can be applied to a boat's propulsion motor, a boat's electricity generator or any other internal combustion motor located on a boat. By locating the exit point for exhaust further from a boat, the present invention helps prevent carbon monoxide pockets from forming at various locations, such as beneath a boat's swim deck. Additionally, by locating the exhaust exit point far from a boat, the inventive device allows the exhaust fumes to mix with air, thereby lowering the concentration of carbon monoxide in air which might waft back toward the boat to be breathed by a boat's passengers.

The inventive device is comprised of a floating hose having an adaptor which can couple to a boat exhaust port. The device can be adapted for coupling to a boat motor exhaust or a boat generator exhaust. Also, in a preferred embodiment, the floating hose is made rigid using one or more extension rods for purposes of keeping the device directed outward and away from the boat.

DETAILED DESCRIPTION OF THE PREFERRED EMBODIMENTS

Figure 1:
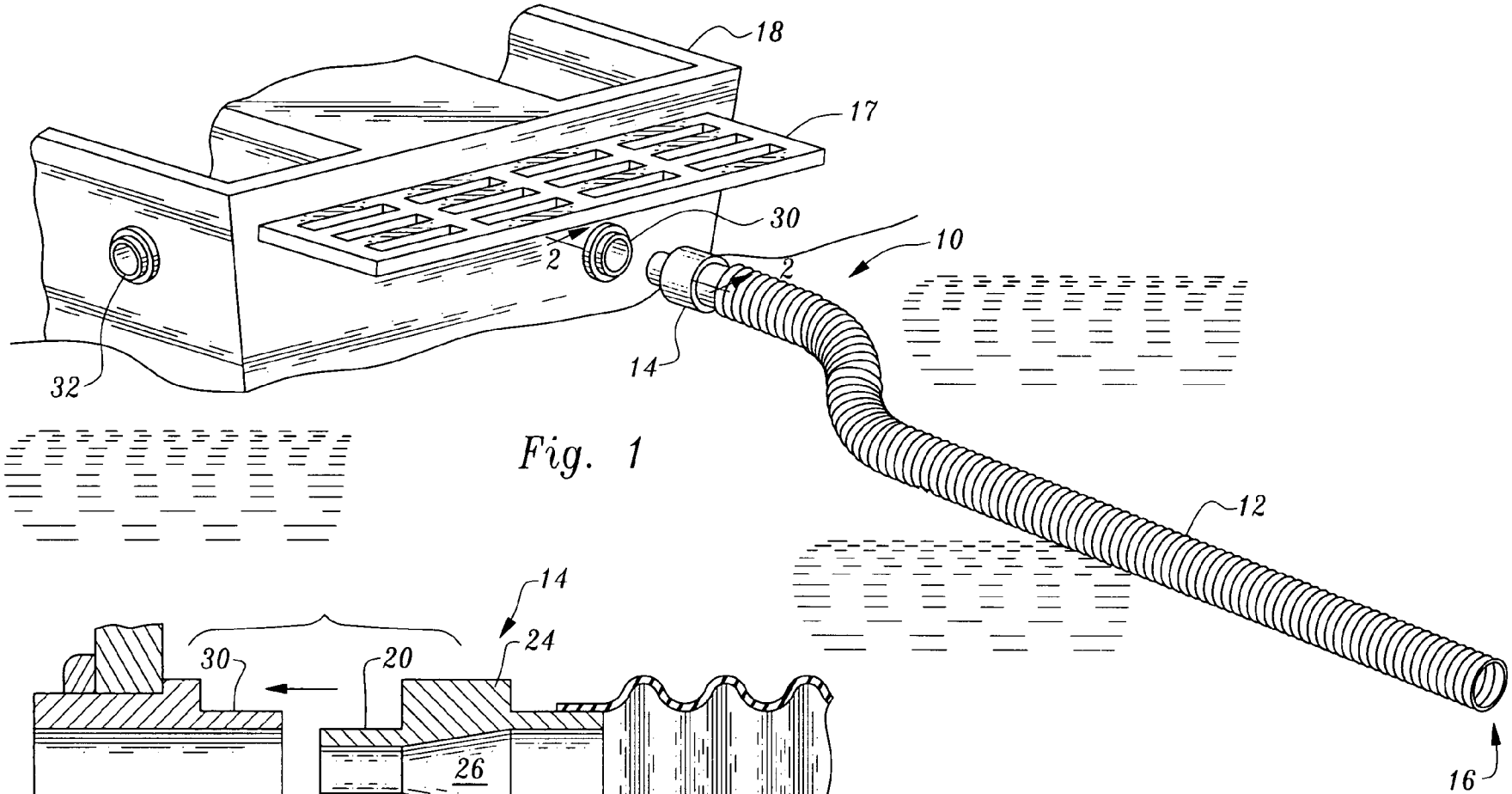
FIG. 1 is a perspective view of a first embodiment of the inventive device shown in position for engaging with a boat motor exhaust port.
Figure 2:
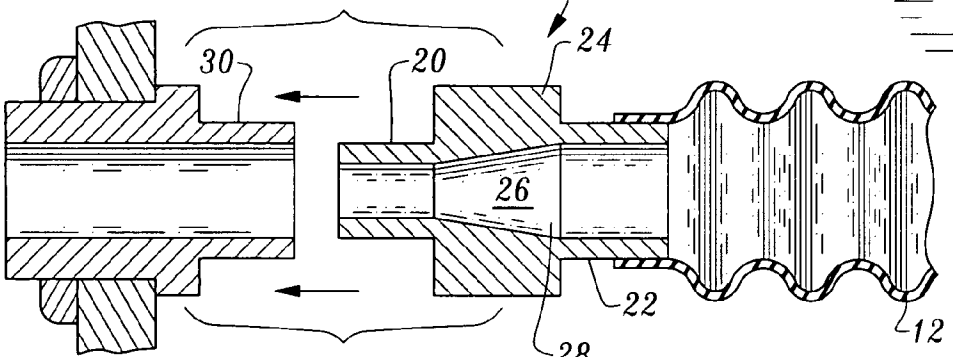
FIG. 2 is a side cutaway view of the device of FIG. 1, shown in position for engaging with a boat motor exhaust port.

The inventive device 10 for redirecting boat motor exhaust is shown in the various Figures illustrated herein. FIGS. 1 and 2 illustrate a basic embodiment of the device 10 comprised of an elongate hose 12 coupled to an exhaust adaptor 14. The hose 12 is preferably a flexible flotation hose which can be accomplished by manufacturing the hose from a flotation material. The inventor has found a hose material sold under the trademark SANTOPRENE® meets the specifications of the invention, as this material is a thermo-plastic flotation material which stands up well to contact with boat motor exhaust. A hose length of 20 feet minimum measured from the adaptor 14 to the distal exhaust opening 16 of the hose 12 is preferred for keeping boat motor exhaust a sufficient distance from a boat 18 and areas of concern, such as beneath the swim deck 17, for example. This distance is also ideal for keeping the distal end of the exhaust hose beyond a teak surfer's body, for example, while the boat is underway, thereby insuring that a teak surfer or swimmer is not under any danger from carbon monoxide poisoning.

Figure 3:
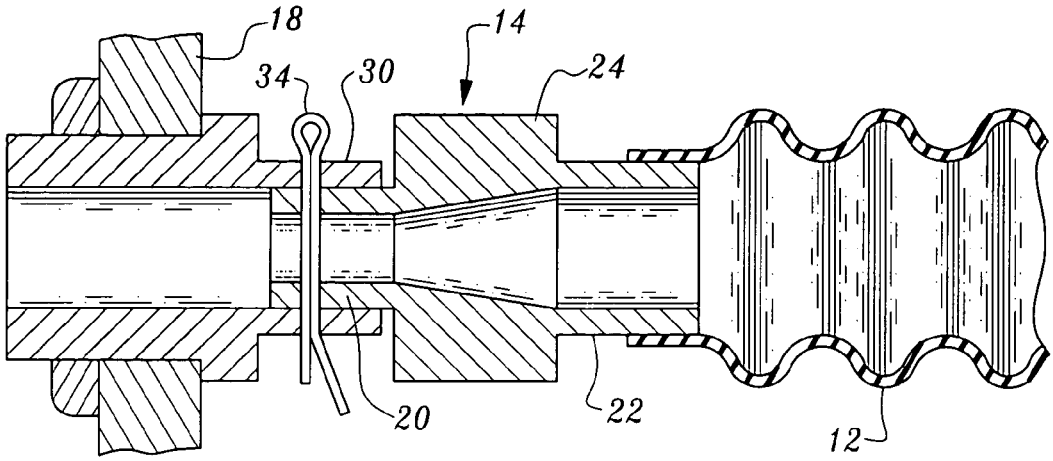
FIG. 3 is a side cutaway view of the device shown attached to a boat motor exhaust port by a cotter pin.

As shown in FIG. 2, one embodiment of the adaptor 14 has two opposing male ends 20, 22 protruding from a central flange 24, namely an exhaust end 20 and a hose end 22. A through-bore 26 extends between the exhaust end 20 and the hose end 22, with the through-bore 26 tapering outward 28 and expanding as it approaches the hose end 22. This gives the exhaust a widened chamber to exit into, as it enters the hose 12, so that excellent flow-through of exhaust is achieved and engine performance is not compromised. For most marine inboard engines, an exhaust hose inside diameter of 3 inches works well to achieve good flow-through. For most boat generators, an exhaust hose inside diameter of 2 inches works well. As shown in FIG. 2, the male hose end 22 inserts into the exhaust hose 12 while the male exhaust end 20 of the adaptor 14 (see arrows) inserts into the boat exhaust port 30 as shown. In the drawings are shown both the propulsion motor exhaust port 30 and the electricity generator exhaust port 32. The invention can be applied to either type of exhaust port. The exhaust end 20 can be a friction fit achieved by machining the exhaust end to fit snugly within the inside diameter of the boat exhaust port. If additional fastening ability is desired, the exhaust end 20 and exhaust port 30, 32 could be drilled through to accept a cotter pin 34, as shown in FIG. 3.

Figure 4:
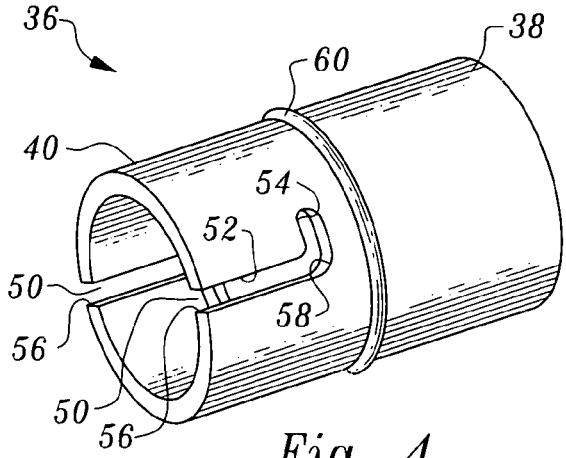
FIG. 4 is a perspective view of an alternative embodiment of the adaptor.
Figure 5:
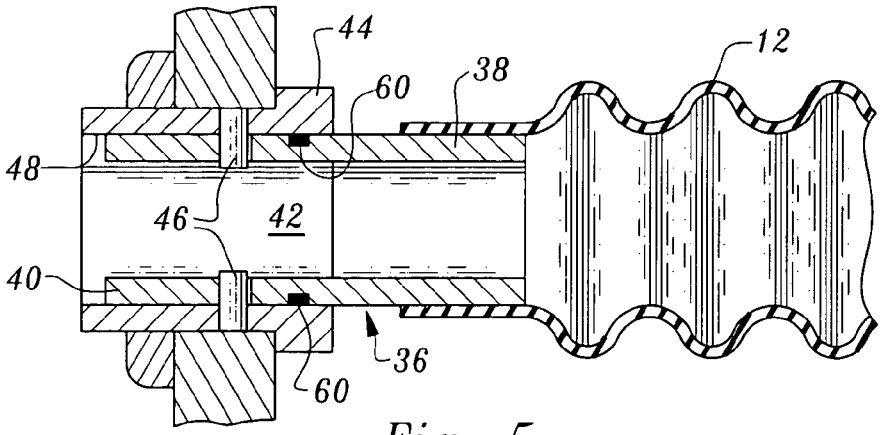
FIG. 5 is a side cutaway view of the inventive device incorporating the adaptor of FIG. 4 engaging with a boat motor exhaust port which has interior pins for engaging with slots located in the adaptor.

An alternative adaptor embodiment 36 is shown in FIGS. 4 and 5. This adaptor 36 also has opposite male ends, one for coupling with an exhaust hose 38 and one for coupling with an exhaust port 40, and a through-bore 42. However, this embodiment is designed for coupling with exhaust ports made from brass through-hole fittings 44 common in the boat building arts. These through-hole fittings 44 are commonly forged with internal pins 46 protruding from their inside diameter surface 48 as shown in FIG. 5. Adaptor 36 has an outside circumference slightly less than the inside circumference of the through-hole fitting 44 to allow the adaptor 36 to slide easily into the through-hole fitting 44. The adaptor 36 includes engaging slots 50 having an elongate portion 52 and an offset portion 54. The elongate portion 52 allows the adaptor 36 to slide inside of the through-hole fitting 44 and engage the pins 46 at its proximal end 56. The pins 46 slide within the elongate portion 52 of slot 50 until they bottom out at the distal end 58 of the elongate portion 52. Upon bottoming out, the user merely gives the adaptor a slight twist to engage the pins 46 snugly within the offset portion 54 of slot 50, thereby holding the adaptor 36 and exhaust hose 12 firmly to the through-hole fitting 44. This twist-lock engagement is simple and reliable. An O-ring 60 is located in a shallow slot imparted into the outside circumference of adaptor 36, the O-ring 60 snugly pressing against the inside circumference of the through-hole fitting 44, creating an exhaust seal to prevent deadly carbon monoxide from escaping between the adaptor 36 and through-hole fitting 44.

Figures 6, 7:
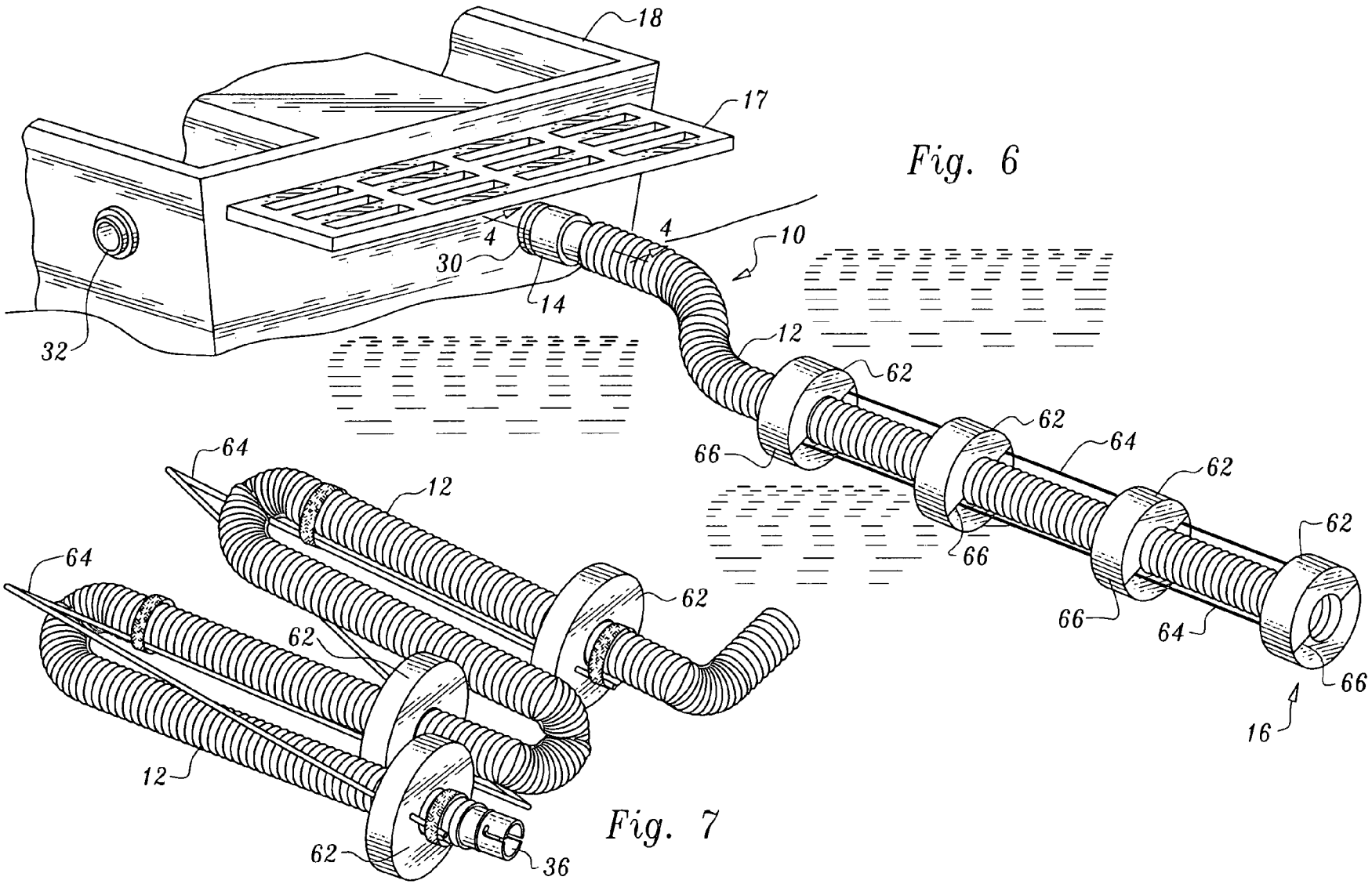
FIG. 6 is a perspective view of an alternative embodiment of the inventive device having an extension rod and being shown in position for engaging with a boat motor exhaust port.
FIG. 7 is a perspective view of an alternative embodiment of the inventive device having a collapsible extension rod and shown folded into a compact configuration.

FIG. 6 illustrates an alternative embodiment of the inventive device 10. This embodiment incorporates the hose 12 and exhaust port adaptor 14 as previously described and additionally incorporates additional flotation means and a means for holding the hose in a rigid configuration so that the distal end 16 of the hose 12 does not curl back toward the boat 18 while releasing exhaust fumes. As shown in FIG. 6 the added flotation means is preferably a plurality of spaced flotation collars 62 surrounding the exhaust hose 12 along its length. The flotation collars 62 can be comprised of foam materials, SANTOPRENE® or any variety of other flotation materials well known in the art. At least one extension rod 64 is inserted into the flotation collars 62 parallel with the exhaust hose 12, the extension rod 64 keeping the hose 12 in a rigid configuration. The extension rod 64 can be inserted into the collars 62 if the collars are partially bisected. The bisected slits 66 align in a parallel orientation with the hose 12, at the same clock face position, along the plurality of collars 62, thereby allowing for the insertion of an extension rod 64. If two rods 64 are used as shown in FIG. 6, the two rods 64 are preferably placed 180 degrees apart. In this embodiment, the rods 64 are of a one-piece construction and are frictionally held within the bisecting slits 66 of the collars 62, which allows them to be taken out at will so that the hose 12 can then be wrapped up and stowed easily when the device 10 is no longer needed.

FIG. 7 shows an alternate embodiment where the rod 64 is of a collapsing variety. The rod 64 can be made to protrude through the flotation collars 62, thereby eliminating the bisecting slits. Because the rod 64 is non-removable in this version, the rod 64 collapses and the hose 12 can be folded up as shown. In both extension rod embodiments shown herein, the extension rod insures that the distal end of the exhaust hose points away from the boat so that dangerous carbon monoxide is not expelled backward toward the boat.

The foregoing written description describes an inventive device for redirecting boat motor exhaust away from a boat. Finally, although the description above contains many specificities, these should not be construed as limiting the scope of the invention, but as merely providing illustrations of some of the presently preferred embodiments of this invention. This invention may be altered and rearranged in numerous ways by one skilled in the art without departing from the coverage of any patent claims which are supported by this specification.

The invention claimed is:

1. A device for redirecting motor exhaust a distance away from a boat, comprising:

an adaptor, said adaptor having a first insertable segment for inserting into a boat's exhaust port and a second insertable segment for inserting into an exhaust extension hose, said first and second insertable segments extending in opposite directions;

said adaptor having a through-bore, said through-bore expanding to a larger diameter at said second insertable segment;

a plurality of equally spaced flotation collars, said flotation collars encircling said exhaust extension hose and extending outward along said hose to a distal end of said hose, said flotation collars each being imparted with a partially bisecting slit, said slit extending in a parallel direction with said exhaust extension hose, said slits on each collar being in clock face alignment with said slits on said other collars; and at least one extension rod, said extension rod being insertable into said bisecting slits of said collars and being held therein by friction engagement, said rod keeping said extension hose in a rigid confirmation along the length of said rod.

2. A device for redirecting motor exhaust a distance away from a boat, comprising:

an adaptor, said adaptor including means for coupling to a boat's motor exhaust port;

a buoyant extension hose, said extension hose extending outward from said adaptor in a direction opposite said exhaust port coupling means; and means for keeping said extension hose in a rigid confirmation so that a distal end of said hose is directed away from a boat to which said device is attached.

3. The device as recited in claim 2, wherein said exhaust port coupling means includes means for engaging pins protruding from the inside circumference of said exhaust port.

4. The device as recited in claim 3, wherein said exhaust port coupling means further comprises an elongate slot, said elongate slot ending in an offset slot, said elongate and offset slots engaging said exhaust port pins in a twist-lock manner.

5. The device as recited in claim 2, wherein said adaptor further comprises means for sealing said adaptor within a boat motor exhaust port.

6. The device as recited in claim 5, wherein said sealing means is an O-ring.

7. The device as recited in claim 2, wherein said means for coupling said adaptor to a boat motor exhaust port further comprises a cotter pin.

8. A device for redirecting motor exhaust a distance away from a boat, comprising:

an adaptor, said adaptor including means for coupling to a boat's motor exhaust port;

an extension hose, said extension hose extending outward from said adaptor in a direction opposite said exhaust port coupling means;

a plurality of buoyant collars through which extends said extension hose; and at least one extension rod, said extension rod being inserted into said collars and extending parallel along said extension hose.

9. The device as recited in claim 8, wherein said collars are maintained in a spaced relation from each other along the length of said extension hose.

10. The device as recited in claim 8, wherein said collars further comprise a partially bisecting slit for removably inserting said extension rod.

11. The device as recited in claim 8, wherein said extension rod is collapsible.

12. The device as recited in claim 8, wherein said adaptor further comprises means for sealing said adaptor within a boat motor exhaust port.

13. The device as recited in claim 12, wherein said sealing means is an O-ring.

14. The device as recited in claim 8, wherein said means for coupling said adaptor to a boat motor exhaust port further comprises a cotter pin.

15. A device for redirecting motor exhaust a distance away from a boat, comprising:

an adaptor, said adaptor including means for coupling to a boat's motor exhaust port;

an extension hose, said extension hose extending outward from said adaptor in a direction opposite said exhaust port coupling means, said extension hose having an open distal end for exiting boat motor exhaust;

a flotation means for keeping said extension hose buoyant in water; and means for maintaining said extension hose in a rigid orientation so as to keep said distal hose end directed away from a boat to which said device is attached.

16. The device as recited in claim 15, wherein said adaptor further comprises means for sealing said adaptor within a boat motor exhaust port.

17. The device as recited in claim 16, wherein said sealing means is an O-ring.

18. The device as recited in claim 15, wherein said means for coupling said adaptor to a boat motor exhaust port further comprises a cotter pin.

* * * * *